US010180007B1

(12) United States Patent
Santini

(10) Patent No.: US 10,180,007 B1
(45) Date of Patent: Jan. 15, 2019

(54) TUBULAR BEAM EXTENSION

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 425 days.

(21) Appl. No.: 15/148,243

(22) Filed: May 6, 2016

(51) Int. Cl.
*E04G 5/06* (2006.01)
*E04G 7/26* (2006.01)

(52) U.S. Cl.
CPC ..... *E04G 7/26* (2013.01); *E04G 5/06* (2013.01)

(58) Field of Classification Search
CPC ..... E04G 7/26; E04G 5/06
See application file for complete search history.

(56) References Cited

U.S. PATENT DOCUMENTS 3,451,183 A 6/1969 Lespagnol et al.
5,263,296 A 11/1993 Spera
9,004,715 B1 4/2015 Litke et al.
9,200,443 B2 12/2015 Marple

OTHER PUBLICATIONS

A printout of a mscdirect.com webpage illustrating a T Slotted Aluminum Extrusion.

*Primary Examiner* — Michael C Miggins
(74) *Attorney, Agent, or Firm* — Donald J. Ersler

(57) ABSTRACT

A tubular beam extension includes three sizes. A first tubular beam extension includes a center tube and four corner retention projections. A single corner retention projection extends outward from each corner of the center tube. Each corner retention projection includes an extension member and a retention member. A retention cavity is formed in the retention member. A second tubular beam extension includes a rectangular tube, the four corner retention projections and four side retention projections. Each side retention projection includes a first extension member, a second extension member and a flange member. A single flange member is located between two adjacent corner retention projections. A third tubular beam extension preferably includes a rectangular tube, the four corner retention projections, two end retention projections and at least four side retention projections.

19 Claims, 7 Drawing Sheets

TUBULAR BEAM EXTENSION

BACKGROUND OF THE INVENTION

1. Field of the Invention

The present invention relates generally to temporary and permanent construction and more specifically to a tubular beam extension, which includes four sides and at least one lengthwise T-slot formed in each side.

2. Discussion of the Prior Art

U.S. Pat. No. 3,451,183 to Lespagnol et al. discloses metal partitions and similar constructions. U.S. Pat. No. 5,263,296 to Spera discloses a modular scaffolding assembly. U.S. Pat. No. 9,004,715 to Litke et al. discloses modular structural frame lighting. U.S. Pat. No. 9,200,443 to Marple discloses a structural attachment system. However, it appears that none of the above patents teach or suggest a tubular beam with four sides, at least one T-slot formed in each side and a lengthwise cavity formed in each corner.

Accordingly, there is a clearly felt need in the art for a tubular beam extension, which includes four sides; at least one lengthwise T-slot formed in each side wall; and a lengthwise cavity formed in each corner.

SUMMARY OF THE INVENTION

The present invention provides a tubular beam extension, which includes four sides; and a lengthwise cavity formed in each corner. The tubular beam extension includes at least three sizes. A first tubular beam extension preferably includes a center tube and four corner retention projections. A single corner retention projection extends outward from each corner of the center tube. Each corner retention projection includes an extension member and a retention member. One end of the extension member extends from a corner of the center tube and the retention member terminates an opposing end of the extension member. A retention cavity is formed in the retention member and extends a length of the retention member. The retention cavity includes a substantially circular cross section. An access slot is formed from an outside corner of the retention member to retention cavity.

A second tubular beam extension preferably includes a rectangular tube, the four corner retention projections and four side retention projections. A single corner retention projection extends outward from each corner of the rectangular tube. Each side retention projection includes a first extension member, a second extension member and a flange member. One end of the first extension member extends from an inner surface of the flange member, such that a first flange is formed on a first end of the flange member. One end of the second extension member extends from an inner surface of the flange member, such that a second flange is formed on a second end of the flange member. The flange member is located between two adjacent corner retention projections. The other ends of the first and second extension members extend from an outer surface of the rectangular tube.

A third tubular beam extension preferably includes a rectangular tube, the four corner retention projections, two end retention projections, at least four side retention projections. A single corner retention projection extends outward from each corner of the rectangular tube. It is preferable to have one end retention projection on each end of the rectangular tube and three retention projections on each side of the rectangular tube. Each end retention projection is located between two adjacent corner retention projections. Each side retention projection is located between a corner retention projection and a center side retention projection. A plurality of splice bars and a plurality of flat head screws may be used to secure at least two tubular beam extensions in series.

Accordingly, it is an object of the present invention to provide a tubular beam extension, which includes four sides; at least one lengthwise T-slot formed in each side wall; and a lengthwise cavity formed in each corner.

These and additional objects, advantages, features and benefits of the present invention will become apparent from the following specification.

DETAILED DESCRIPTION OF THE PREFERRED EMBODIMENTS

Figure 1:
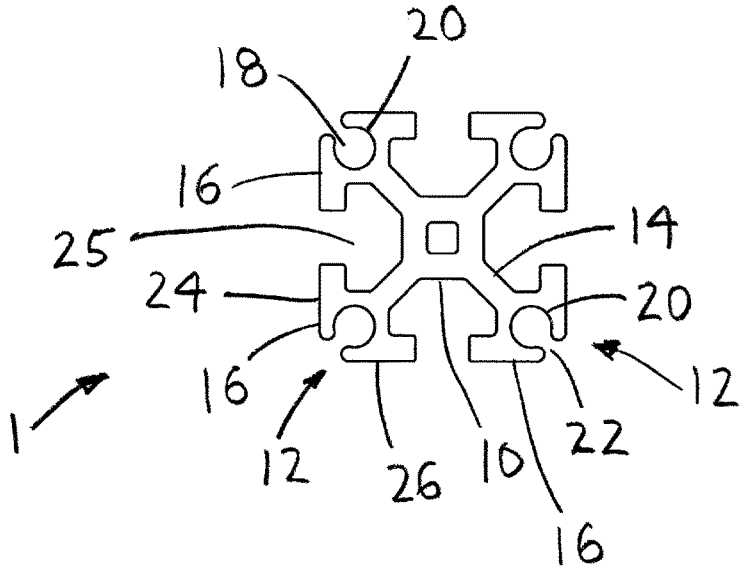
FIG. 1 is an end view of a first tubular beam extension in accordance with the present invention.
Figure 2:
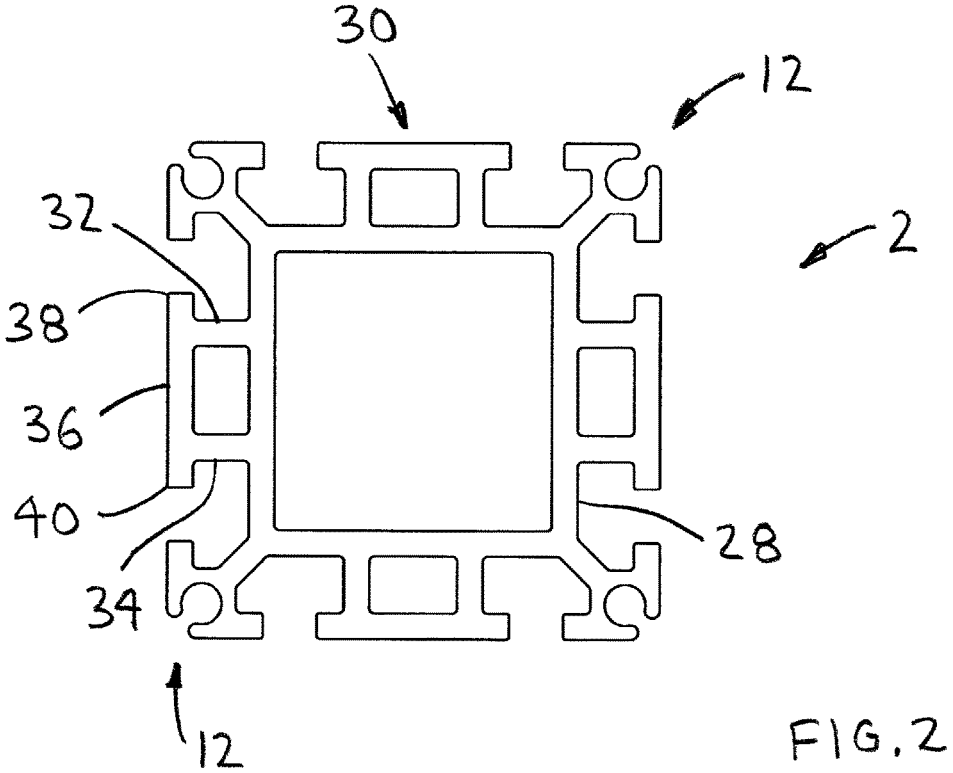
FIG. 2 is an end view of a second tubular beam extension in accordance with the present invention.
Figure 3:
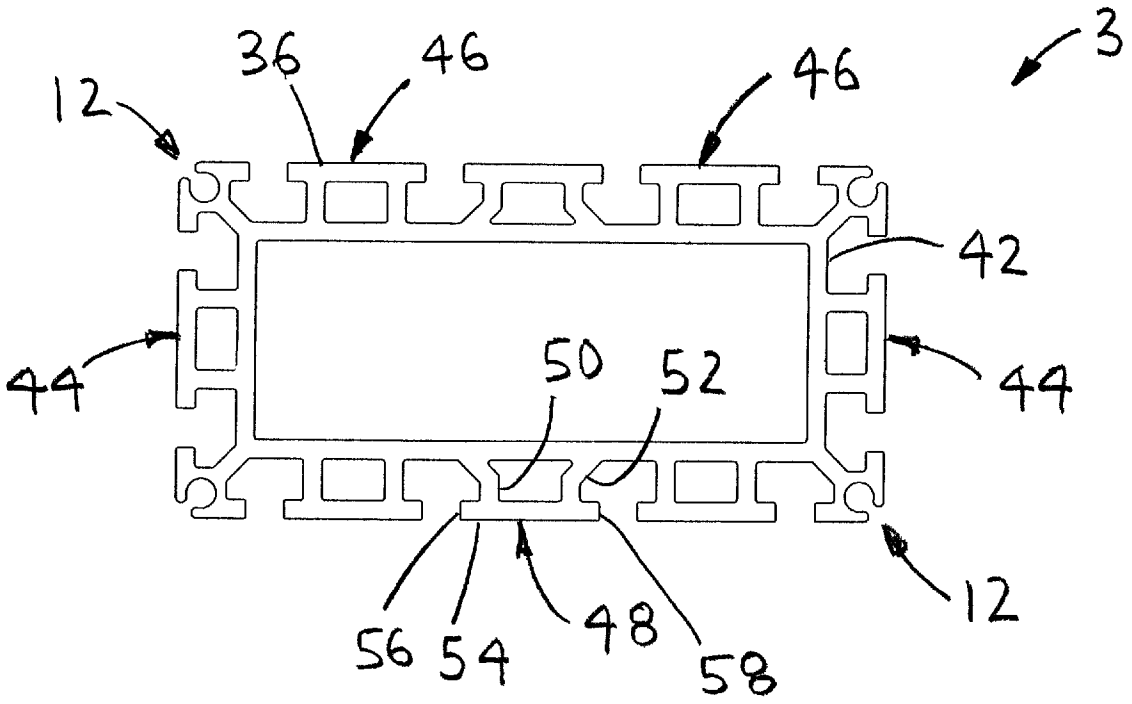
FIG. 3 is an end view of a third tubular beam extension in accordance with the present invention.

With reference now to the drawings, and particularly to FIG. 1, there is shown an end view of a first tubular beam extension 1. With reference to FIG. 2, an end view of a second tubular beam extension 2 is shown. With reference to FIG. 3, a third tubular beam extension 3 is shown. The first tubular beam extension 1 preferably includes a center tube 10 and four corner retention projections 12. A single corner retention projection 12 extends outward from each corner of the center tube 10. Each corner retention projection 12 includes an extension member 14 and a retention member 16. One end of the extension member 14 extends from a corner of the center tube 10 at an acute angle and the retention member 16 terminates an opposing end of the extension member 14. A retention cavity 18 is formed in the retention member 16 and extends a length of the retention member 16. The retention cavity 16 includes a substantially circular cross section 20. An access slot 22 is formed from an outside corner of the retention member 16 to retention cavity 20. The retention member 16 includes a first flange leg 24 and a second flange leg 26. The first flange leg 24 is substantially perpendicular to the second flange leg 26. The first and second flange legs 24, 26 are preferably parallel to outer surfaces of the center tube 10. A T-slot 25 is formed between two adjacent corner retention projections 12.

The second tubular beam extension 2 preferably includes a rectangular tube 28, the four corner retention projections 12 and four side retention projections 30. A single corner retention projection 12 extends outward from each corner of the rectangular tube 28. Each side retention projection 30 includes a first extension member 32, a second extension member 34 and a flange member 36. One end of the first extension member 32 extends from an inner surface of the flange member 36, such that a first flange 38 is formed on a first end of the flange member 36. One end of the second extension member 34 extends from an inner surface of the flange member 36, such that a second flange 40 is formed on a second end of the flange member 36. The flange member 30 is located between two adjacent corner retention projections 12. The other ends of the first and second extension members 32, 34 extend from an outer surface of the rectangular tube 28.

The third tubular beam extension 3 preferably includes a rectangular tube 42, the four corner retention projections 12, two end retention projections 44 and four side retention projections 46 and two center side retention projections 48. The end retention projections 44 and the side retention projections 46 are structurally the same as the side retention projections 30. A single corner retention projection 12 extends outward from each corner of the rectangular tube 42. It is preferable to have one end retention projection 44 on each end of the rectangular tube 42 and three side retention projections 46, 48 on each side of the rectangular tube 42. Each end retention projection 44 is located between two adjacent corner retention projections 12. Each center side projection 48 includes a first angled leg 50, a second angled leg 52 and a flange member 54. One end of the first angled leg 50 extends from an inner surface of the flange member 54, such that a first flange 56 is formed on a first end of the flange member 54. One end of the second angled leg 52 extends from an inner surface of the flange member 52, such that a second flange 58 is formed on a second end of the flange member 54. The side retention projections 46 are located between one corner retention projection 12 and the center side retention projection 48. The other ends of the first and second extension members 32, 34 extend from an outer surface of the rectangular tube 42 for the end and side retention projections 44, 46. The other ends of the first and second angle legs 50, 52 extend from an outer surface of the rectangular tube 42.

Figure 4:
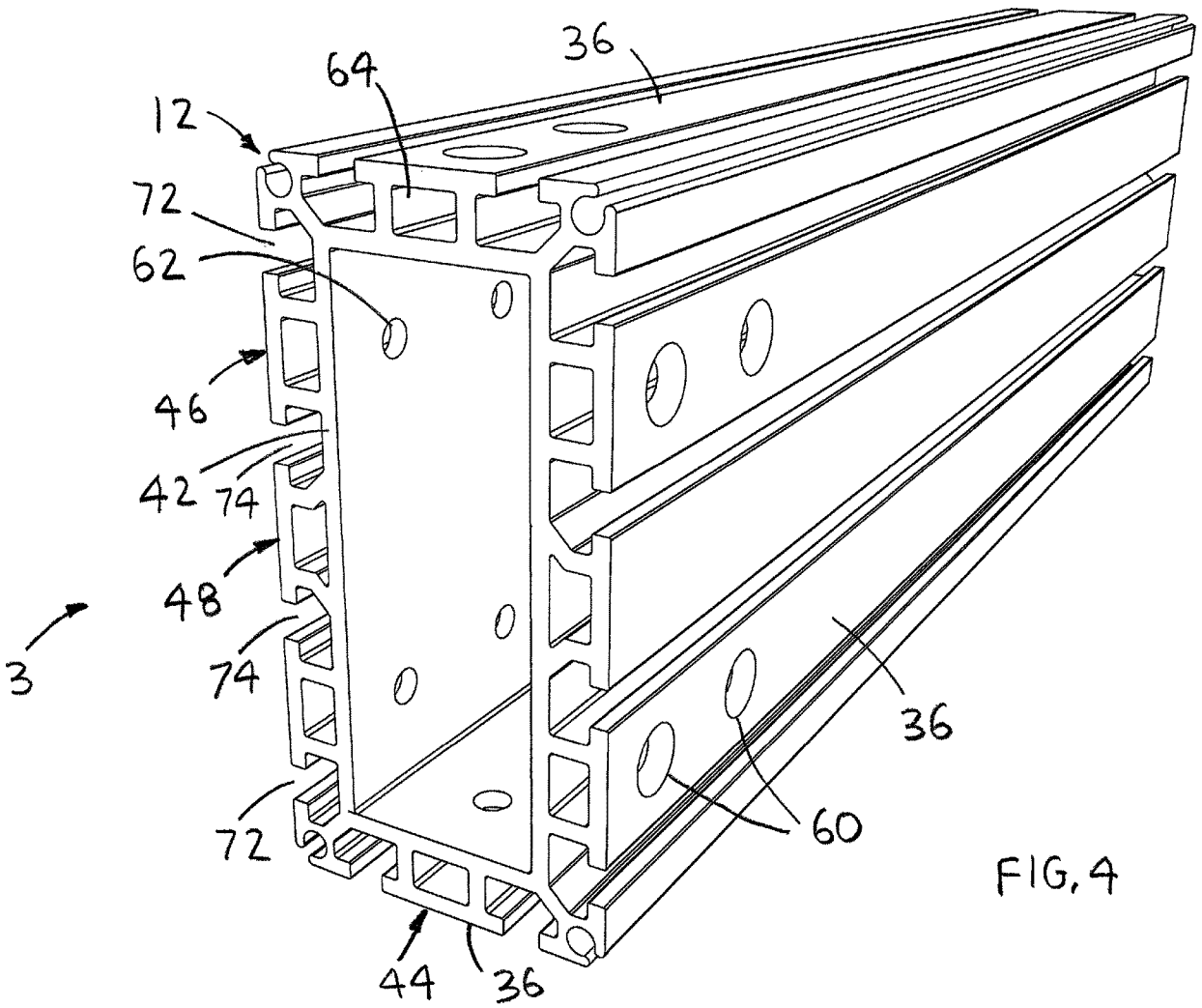
FIG. 4 is a perspective view of a third tubular beam extension in accordance with the present invention.
Figure 5:
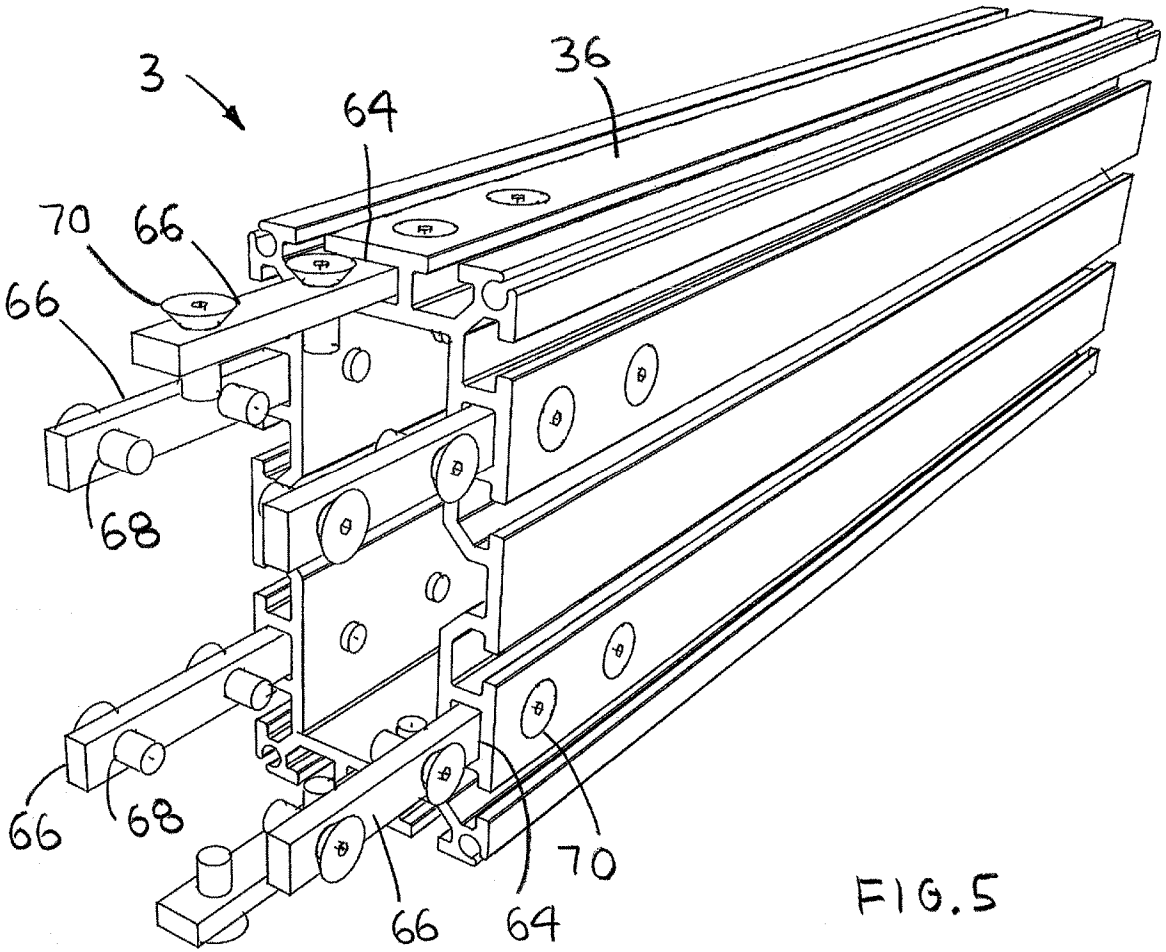
FIG. 5 is a perspective view of a plurality of splice bars extending from an end of a third tubular beam extension in accordance with the present invention.
Figure 6:
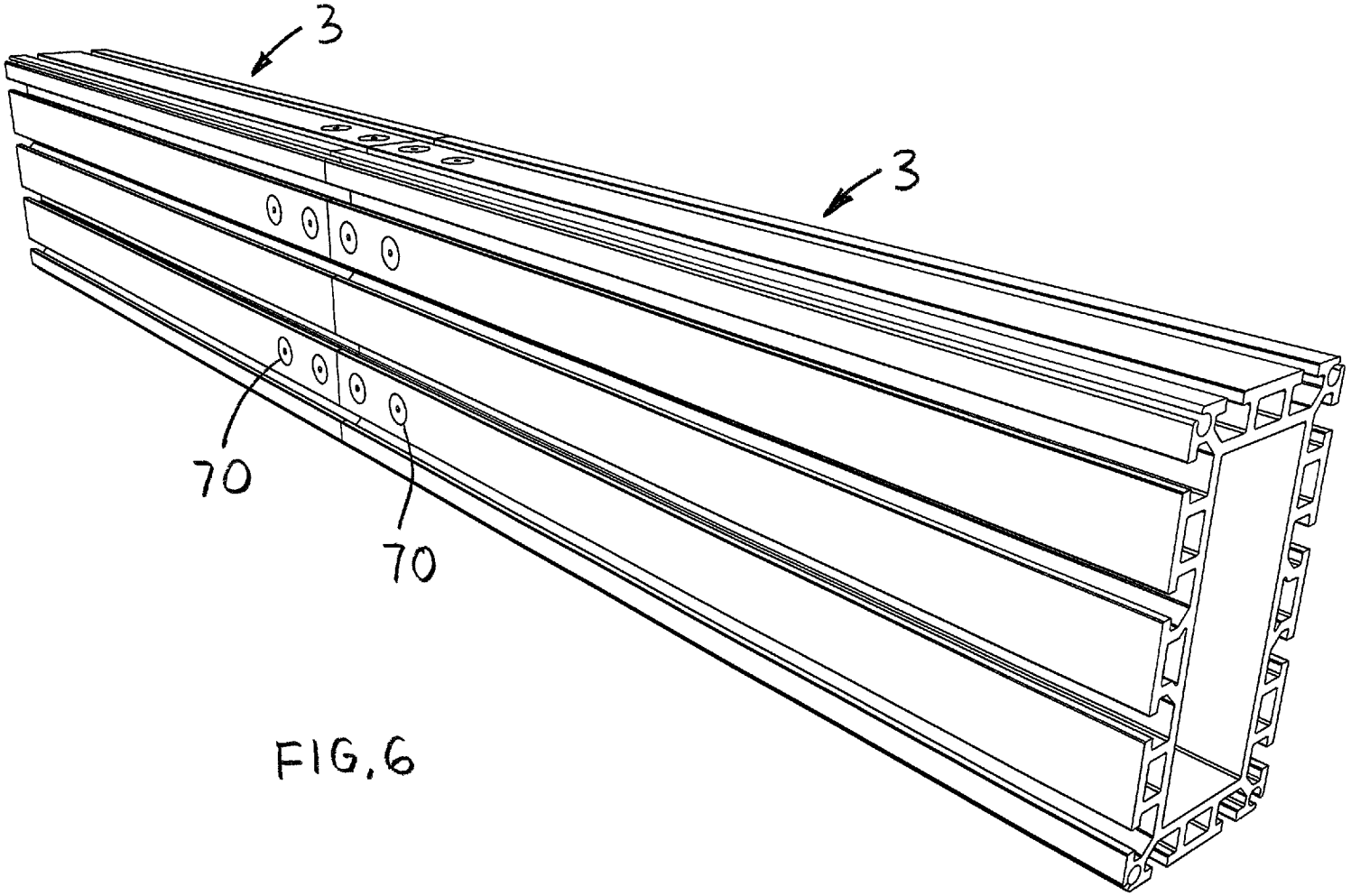
FIG. 6 is a perspective view of ends of two third tubular beam extensions secured to each other in accordance with the present invention.

With reference to FIG. 4, a plurality of countersunk holes 60 are formed through six flange members 36 in one end of the third tubular beam extension 3. A fastener hole 62 is formed through a wall of the rectangular tube 42. With reference to FIG. 5, a splice bar cavity 64 is formed between each side retention projection 44, 46, 48 and the rectangular tube 42 to receive a splice bar 66. Each splice bar 66 includes at least two threaded holes 68 to threadably receive a thread of a flat head screw 70. With reference to FIG. 6, the plurality of splice bars 66 and the plurality of flat head screws 70 are used to secure at least two tubular beam extensions 3 in series.

Figure 7:
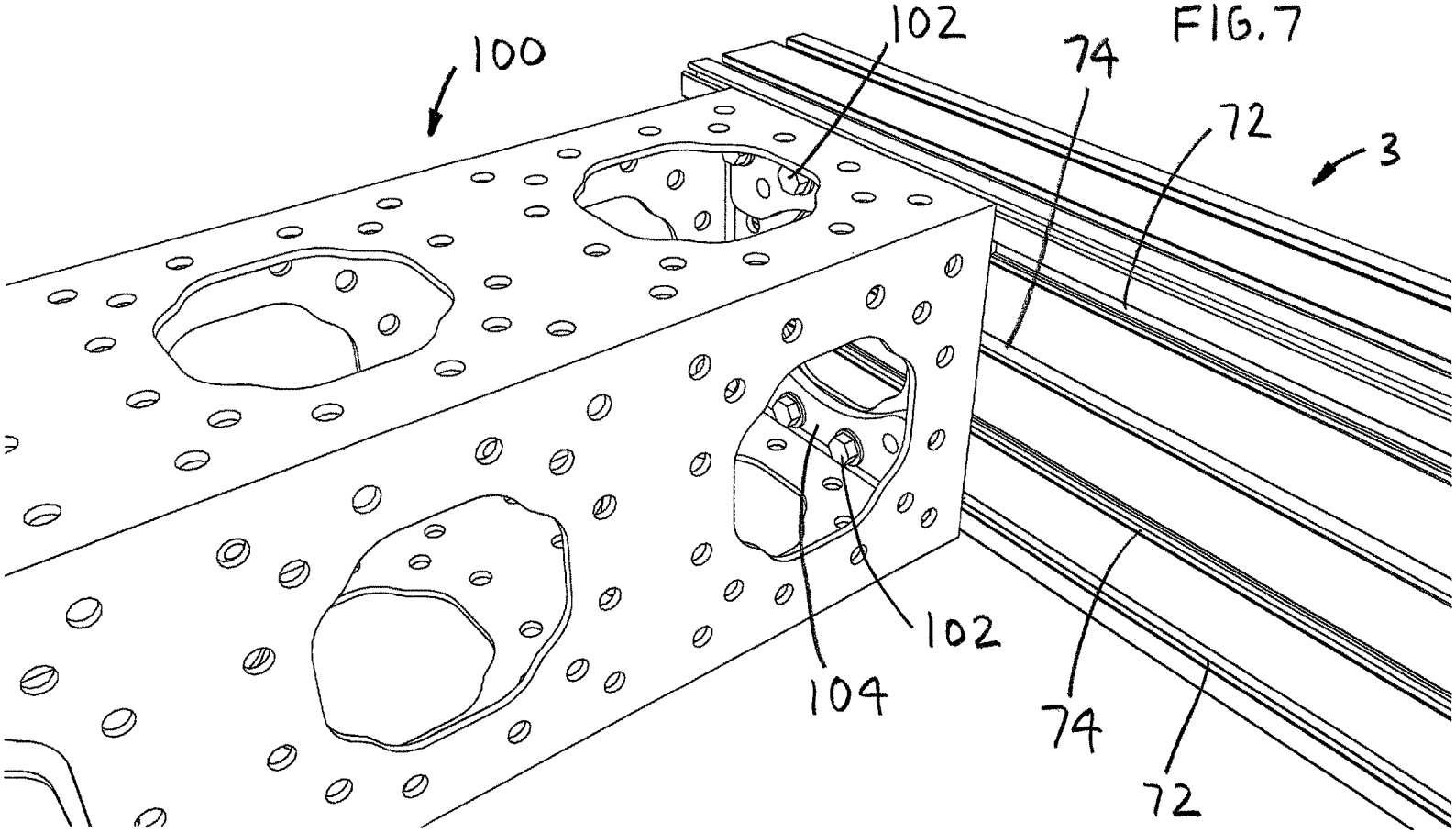
FIG. 7 is a perspective view of an end of a tubular beam attached to a third tubular beam extension in accordance with the present invention.
Figure 8:
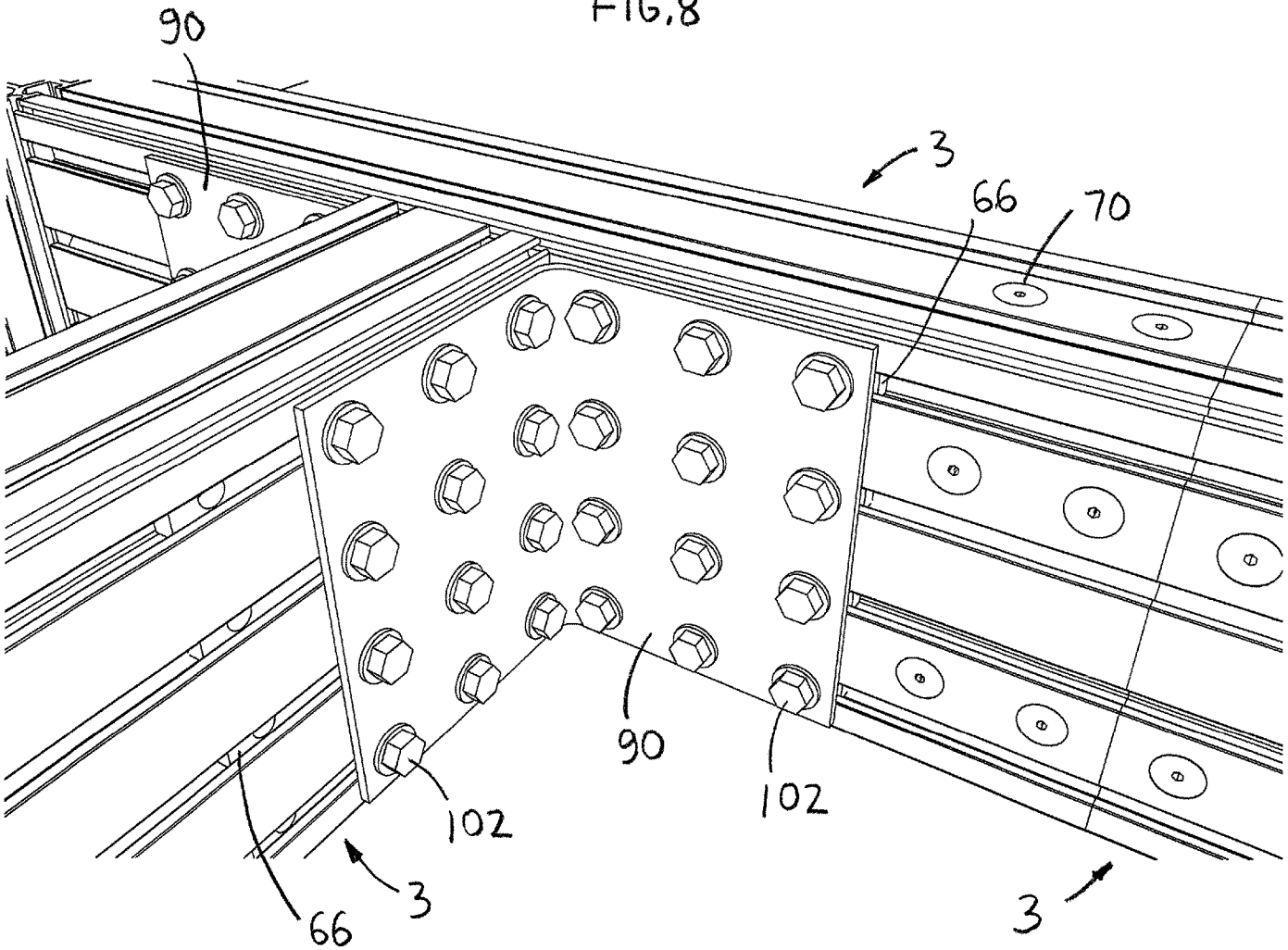
FIG. 8 is a perspective view of an end of a third tubular beam attached to a side of another third tubular beam extension with two right angle plates, a plurality of fasteners and a plurality of splice bars in accordance with the present invention.

With reference to FIG. 7, an end of a tubular beam 100 as disclosed in U.S. Pat. No. 8,418,425 is attached to the tubular beam extension 3 with a plurality of threaded fasteners 102 and a plurality of splice bars 66 (not shown). U.S. Pat. No. 8,418,425 is herein incorporated by reference in its entirety. With reference to FIG. 4, the plurality of splice bars 66 may also be slid into T-slots 72 formed between the corner retention projection 12 and the side retention projection 46, and T-slots 74 formed between the side retention projection 46 and the center side retention projection 48. The plurality of splice bars 66 may be inserted from an end of the T-slots 72, 74 into a front of thereof. The plurality of threaded fasteners 102 are inserted through holes in an end plate 104 of the tubular beam 100 and threaded into the threaded holes 68 in the splice bars 66. With reference to FIG. 8, an end of one tubular beam extension 3 is attached to an end of another tubular beam extension 3 with two right angle plates 90, the plurality of splice bars 66 and the plurality of threaded fasteners 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A tubular beam extension comprising:

a center tube includes four side walls and four corners; and four corner retention projections extend outward from said four corners of said center tube, each one of said four corner retention projections includes an extension member and a retention member, one end of said extension member extends from one of said four corners at an acute angle relative to one of said four side walls, said retention member terminates an opposing end of said extension member, said retention member includes a first flange leg and a second flange leg, said first flange leg is substantially perpendicular to said second flange leg.

2. The tubular beam extension of claim 1 wherein:

said first and second flange legs are substantially parallel to outer surfaces of said center tube.

3. The tubular beam extension of claim 1 wherein:

said first flange extends past an end of said extension member to form a first overhung lip, said second flange extends past an end of said extension member to form a second overhung lip.

4. The tubular beam extension of claim 1 wherein:

a retention cavity is formed in said corner retention member, said retention cavity extends a length of said corner retention member.

5. The tubular beam extension of claim 4 wherein:

an access slot is formed from an outside corner of said corner retention member to said retention cavity.

6. The tubular beam extension of claim 4 wherein:

said retention cavity includes a substantially round cross section.

7. A tubular beam extension comprising:

a center tube includes four side walls and four corners;

four corner retention projections extend outward from said four corners of said center tube, each one of said four corner retention projections includes a corner extension member and a corner retention member, one end of said corner extension member extends from one of said four corners at an acute angle relative to one of said four side walls, said corner retention member terminates an opposing end of said corner extension member; and four side retention projections extend outward from said four walls of said center tube, each one of said four side retention projections includes at least one extension member and a flange member, one end of said at least one extension member extends outward from one of said four walls of said center tube, said flange member terminates an opposing end of said at least one extension member, said flange member is located between two adjacent corner retention projections of said four corner retention projections.

8. The tubular beam extension of claim 7 wherein:

said first and second flange legs are substantially parallel to outer surfaces of said center tube.

9. The tubular beam extension of claim 7 wherein:

a first flange leg extends past an end of said corner extension member to form a first overhung leg lip, a second flange leg extends past an end of said corner extension member to form a second overhung leg lip.

10. The tubular beam extension of claim 7 wherein:

said flange member extends past opposing sides of said at least one extension member to form a first overhung lip and a second overhung lip.

11. The tubular beam extension of claim 7 wherein:

a retention cavity is formed in said corner retention member, said retention cavity extends a length of said corner retention member.

12. The tubular beam extension of claim 11 wherein:

an access slot is formed from outside surface of said retention member to said retention cavity.

13. The tubular beam extension of claim 11 wherein:

said retention cavity includes a substantially round cross section.

14. A tubular beam extension comprising:

a center tube includes four corners;

four corner retention projections extend outward from said four corners of said center tube, each one of said four corner retention projections includes a corner extension member and a corner retention member, one end of said corner extension member extends from one of said four corners at an acute angle relative to one of said four side walls, said corner retention member terminates an opposing end of said corner extension member;

an end retention projection extends outward from opposing ends of said center tube, said end retention projections includes at least one extension member and a flange member, one end of said at least one extension member extends outward from said center tube, said flange member terminates an opposing end of said at least one extension member, said flange member is located between two adjacent corner retention projections of said four corner retention projections; and at least two side retention projections extend outward from opposing sides of said center tube.

15. The tubular beam extension of claim 14 wherein:

a retention cavity is formed in said corner retention member, said retention cavity extends a length of said corner retention member.

16. The tubular beam extension of claim 14 wherein:

said at least two side retention projections are located between two corner retention projections.

17. The tubular beam extension of claim 14 wherein:

a center side retention projection is retained between two side retention projections.

18. The tubular beam extension of claim 14 wherein:

a first flange leg extends past an end of said corner extension member to form a first overhung leg lip, a second flange leg extends past an end of said corner extension member to form a second overhung leg lip.

19. The tubular beam extension of claim 14 wherein:

said flange member extends past opposing sides of said at least one extension member to form a first overhung lip and a second overhung lip.

* * * * *